United States Patent [19]

Coltrane et al.

[11] Patent Number: 5,011,021

[45] Date of Patent: Apr. 30, 1991

[54] EASY UNPACKING DEEP CONTAINER

[75] Inventors: Jack D. Coltrane, Trinity; Joseph R. Kushner, High Point, both of N.C.

[73] Assignee: Burlington Industries, Inc., Greensboro, N.C.

[21] Appl. No.: 476,304

[22] Filed: Feb. 7, 1990

[51] Int. Cl.[5] ..... B65D 5/54

[52] U.S. Cl. ..... 206/620; 53/382.1; 229/122; 229/123; 493/63

[58] Field of Search ..... 229/122, 123; 206/620; 53/381 R, 382; 493/63, 340, 363

[56] References Cited

U.S. PATENT DOCUMENTS

| | | | |
|---|---|---|---|
| Re. 29,013 | 10/1976 | Faires et al. . | |
| 1,905,992 | 4/1933 | Bogren . | |
| 2,259,041 | 10/1941 | Larkin . | |
| 2,301,310 | 11/1942 | Messer . | |
| 2,348,140 | 5/1944 | Levin . | |
| 2,407,865 | 9/1946 | Biskamp . | |
| 2,442,699 | 6/1948 | Locke, Jr. et al. | 206/620 |
| 2,447,677 | 8/1948 | Williams . | |
| 2,453,614 | 11/1948 | Belsinger . | |
| 2,465,842 | 3/1949 | Brooks . | |
| 2,512,539 | 6/1950 | Belsinger . | |
| 2,635,802 | 4/1953 | Belsinger . | |
| 2,648,480 | 8/1953 | Belsinger . | |
| 2,797,039 | 6/1957 | Belsinger . | |
| 2,974,779 | 3/1961 | Belsinger . | |
| 3,262,631 | 7/1966 | Belsinger . | |
| 3,294,221 | 12/1966 | Notko et al. | 229/122 |
| 3,370,776 | 2/1968 | Krzyzaowski | 206/620 |
| 3,567,102 | 3/1971 | Miller . | |
| 3,666,167 | 5/1972 | Watts . | |
| 3,756,502 | 9/1973 | Swanson et al. | 206/620 |
| 3,827,622 | 8/1974 | McCloud . | |
| 3,891,137 | 6/1975 | Ellison et al. . | |
| 3,954,221 | 5/1976 | Johnson . | |
| 4,382,504 | 5/1983 | Vesborg | 229/123 |
| 4,580,718 | 4/1986 | Muise . | |
| 4,921,105 | 5/1990 | Culbreath | 206/620 |

*Primary Examiner*—Gary E. Elkins

*Attorney, Agent, or Firm*—Nixon & Vanderhye

[57] ABSTRACT

A cardboard, paperboard, or fiberboard carton having a generally-rectangular parallepiped configuration is constructed and utilized so that even when the carton is deep, items packed at the bottom of the carton can be easily removed. Side panels of the parallepiped carton each have vertical corners extending along the lengths of its edges. The lines of separation are formed at the corners defining one of the side panels. The lines of separation, such as through-extending slits or perforations, are spaced from but near the top of the container (e.g., at a distance about one to four inches from the top of the container) and extend several inches toward the middle of the container, being spaced from the bottom. A horizontal score line may be provided at the bottom of the lines of separation, to facilitate bending over the side panel between the lines of separation once the top of the carton has been unpacked and it is desirable to unpack the bottom of the container.

20 Claims, 2 Drawing Sheets

EASY UNPACKING DEEP CONTAINER

BACKGROUND AND SUMMARY OF THE INVENTION

Cartons or containers of cardboard, paperboard, or fiberboard are one of the most common mechanisms for the transportation of goods, providing relatively secure and inexpensive packaging for goods during transport. Many different goods—for example, tubes of textured yarn—are packaged in deep containers. The containers are deep enough so that it is difficult to remove the packaged goods, such as yarn tubes, that are on the bottom of the container, such goods not being within easy reach of a worker bending over a side panel of the container. While packaging of deep containers is relatively simply since special tilt tables or related devices are utilized at the packaging site, such special devices are rarely available where the goods are to be unpacked.

There have been many systems proposed in the prior art to facilitate unpacking of the bottoms of deep cartons. Some prior art proposals provide angled score lines extending from the top of the carton to a mid-point of the carton, in one of the side panels, to facilitate access to the bottom of the container through that side panel. Oftentimes, a slit is defined in the carton bisecting the angled score lines, and extending from the top of the carton to the intersection of the score lines. According to another proposal, one of the side panels is formed with a flap portion, having sides that are detached from the rest of the panel, and spaced from the corners of the carton. Typically, tape is used to hold the edges of the flap—which extend all the way up to the top of the carton—in place until access to the bottom of the carton is needed, at which time the tape is removed and the flap is folded down.

While such prior proposals can provide effective structures for allowing access to the bottom of the containers, they require a number of extra steps in the formation of the carton, or provide a carton that is weaker than desirable during shipment.

According to the present invention, a carton, a method of constructing a carton, and a method of unpacking a carton, are provided which have advantages over a number of prior art proposals. According to the present invention, it is possible to provide for the ready unpacking of the bottom of a deep carton while requiring only a few minor additional operations in the manufacture of the carton, and while maximizing carton integrity during transportation. That is, the mechanisms that are utilized for facilitating the carton bottom unpacking do not substantially weaken the structural integrity of the carton when it is used for its primary goods-transporting purpose.

According to one aspect of the present invention, a cardboard carton is provided. While in the present specification and claims the carton will be described as having a "cardboard" construction, it is to be understood that the term "cardboard" is used in a broad sense, and includes paperboard and fiberboard, corrugated or uncorrugated, and like conventional carton materials.

One aspect of the invention relates to a cardboard container of generally a rectangular parallepiped shape, comprising four side panels defining the walls of the parallepiped and having a top and a bottom, and connected together at generally vertically extending corners and having a bottom. Means are provided defining a line of separation at least the corners on opposite sides of one of the panels, the lines of separation in the corners being adjacent, but spaced from, the top of the panel and the lines of separation having sufficient length so that upon impacting or cutting the portions of the corners above the lines of separation the upper portion of the side panel may be readily detached at said corners, and folded over to allow ready access to the bottom interior of the parallepiped. The lines of separation preferably are through-extending slits, but may also be perforations. For a typical construction for a deep carton, the lines of separation start at a point about one to four inches from the top of the carton, and extend several inches down toward the central portion of the carton. It is also desirable to provide a horizontal score line in the panel between the lines of separation. The horizontal score line preferably is at the bottoms of the lines of separation, and provides for easy folding over of the side panel when it is desired to unpack the bottom of the carton.

According to another aspect of the present invention, there is provided a method of constructing a cardboard generally rectangular parallepiped shaped container having four side panels, and a bottom, so that at least one of said side panels may be readily bent over from a top portion thereof to allow access to the bottom interior of the container. The method comprises the step of defining lines of separation in two adjacent corners, on opposite sides of the same panel, the lines of separation extending from a point near, but spaced from, the top of the corner to a more central point of the corner, spaced a relatively large distance from the bottom of the container. The step of defining the lines of separation may be practiced by defining through extending slits, or perforations, and preferably the step of defining a horizontal score line in the side panel between the lines of separation is also provided.

According to yet another aspect of the present invention, there is provided a method of opening a cardboard carton having a generally-rectangular parallepiped shape with four side panels and corners interconnecting the side panels, each side panel being defined by two adjacent vertically-extending corners, the carton having a top and a bottom, and lines of separation in a pair of adjacent corners, the lines of separation near, but spaced from, the top of the carton so that adjacent side panels are connected at the corner above said lines of separation by a connecting portion. The method comprises the steps of opening up the top of the carton, unpacking articles from the upper portions of the carton, severing the connecting portions at the top of the carton, folding down the side panel at a horizontal portion at the bottom of the lines of separation, and unloading the bottom of the carton. The step of severing the connecting portions may be practiced by a worker impacting the connecting portions with his/her hands, or by cutting them with a blade, or even tearing up from the lines of separation (especially where the lines of separation are through-extending slits). The folding over step may be practiced at a horizontal score line in the panel being folded over.

It is a primary object of the present invention to provide for the simple, inexpensive, yet effective transportation of goods in deep cardboard cartons, and the ready unloading of the bottoms of the cartons. This and other objects of the invention will become clear from an inspection of the detailed description of the invention, and from the appended claims.

DETAILED DESCRIPTION OF THE DRAWINGS

Figure 1:
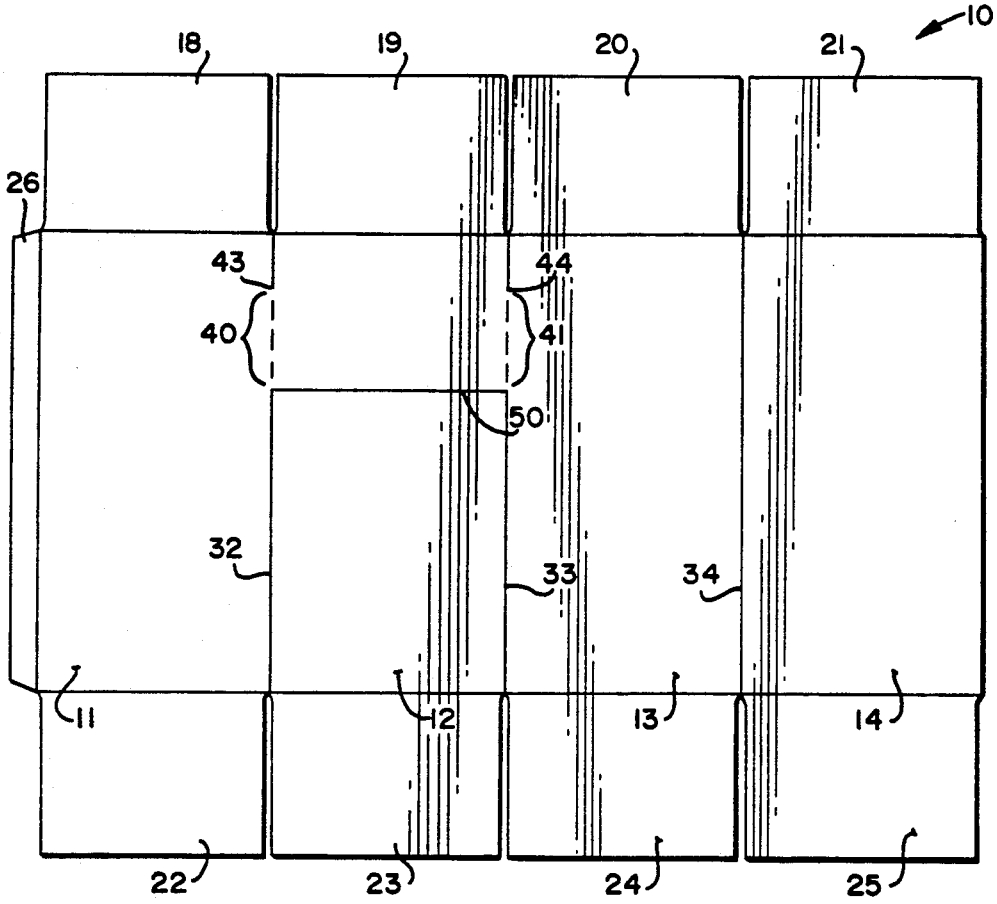
FIG. 1 is a top plan view of a cardboard carton blank constructed according to the method of the present invention.

A carton blank for constructing a generally rectangular parallepiped carton according to the present invention is shown generally by reference numeral 10 in FIG. 1. The blank 10 is of sheet material, preferably "cardboard" (e.g., cardboard, paperboard, fiberboard, corrugated or uncorrugated). The sheet material has a number of panels 11 through 14 which will ultimately form the side panels of a completed carton 15 (see FIGS. 2 through 4). Each of these panels has top and bottom panel portions or flaps, the top flaps being indicated by reference numerals 18 through 21, and the bottom flaps by reference numerals 22 through 25. The carton is ultimately folded over into a rectangular parallepiped shape and an edge flap 26 of the panel 11 is connected by staples, adhesive and/or tape, or the like, to the panel 14. The bottom flaps 22 through 25 are connected to each other in any desired conventional manner, and the top flaps 18 through 21 are folded over into a juxtaposition closing the top of the carton 15, and are taped or otherwise affixed in place in a conventional manner.

In the practice of a method of constructing a carton according to the present invention, the only additional operations aside from the normal formation of the carton from the carton blank is the provision of lines of separation near the top (although spaced therefrom) of the carton at the corners defining one side panel, and a horizontal score line. In the exemplary embodiment illustrated in the drawing, the lines of separation are shown on either side of the side panel 12. It is to be understood that they may be provided elsewhere instead of on opposite sides of the panel 12, or in addition thereto.

Figure 2:
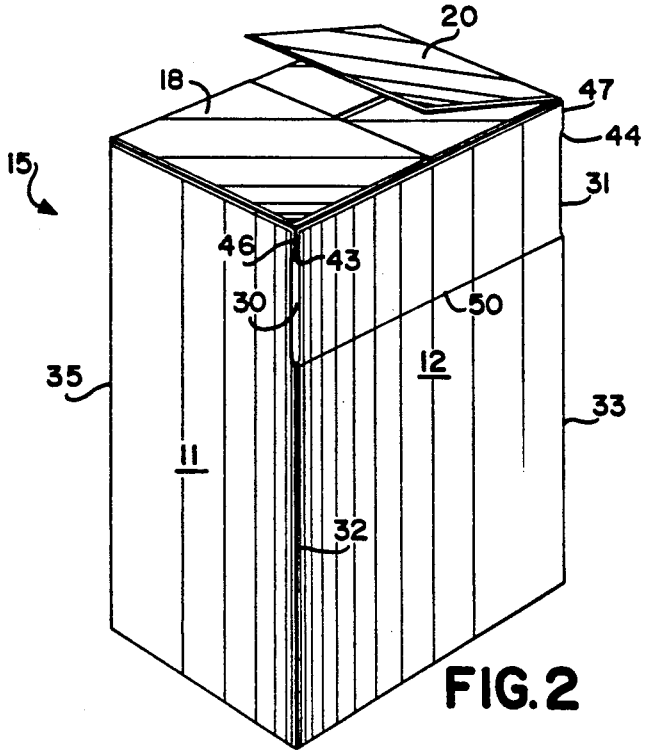
FIG. 2 is a top perspective view of a rectangular parallepiped cardboard carton according to the invention.
Figure 3:
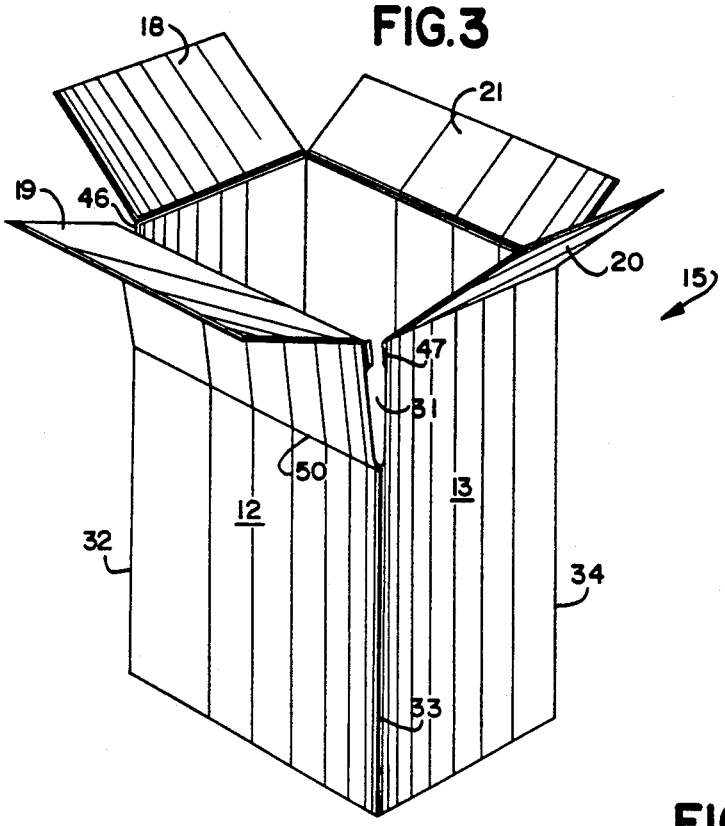
FIG. 3 is a view like that of FIG. 2 only showing the connecting portions above the lines of separation of edges of the carton being severed, and the carton open.
Figure 4:
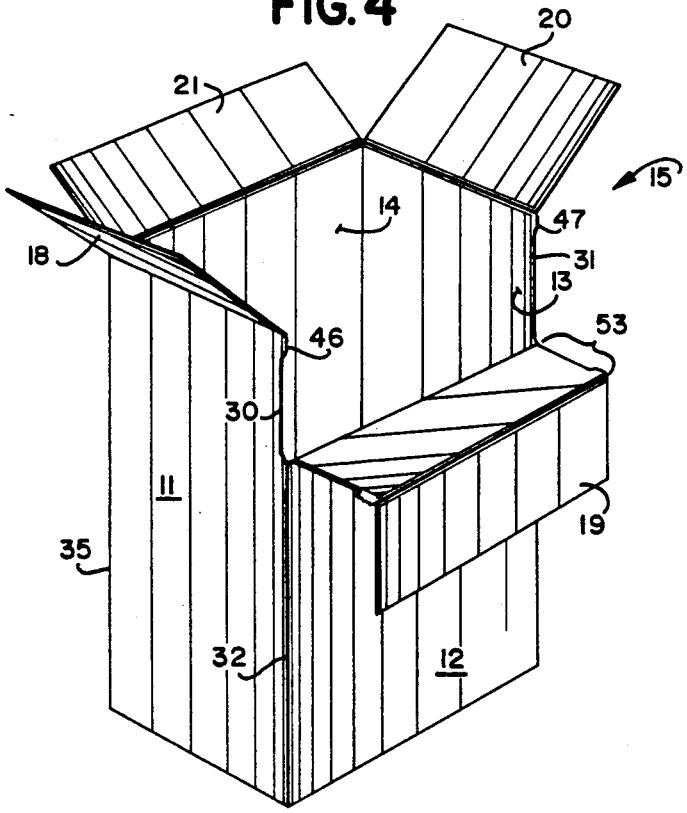
FIG. 4 is a view like that of FIGS. 2 and 3 only showing a side panel of the carton folded down at a horizontal score line to allow easy unpacking of the bottom of the carton.

The lines of separation in FIGS. 2 through 4 are illustrated as through-extending slits 30, 31 formed in the carton at the corners 32, 33 on opposite sides of the panel 12. Normally, lines of separation would not be formed in the corners 34, 35, although under some circumstances, they could be formed there too. Alternatively, the lines of separation—instead of through-extending slits 30, 31—could be perforations 40, 41, as illustrated in FIG. 1.

Note that the lines of separation are provided so that the top 43, 44 of each of the lines of separation is adjacent, but spaced from, the top of the container 15. That is, a connecting portion 46, 47 is provided at each of the corners 32, 33 above the slots 30, 31. These connecting portions 46, 47 will vary in dimension depending upon the particular cardboard material of which the carton 15 is constructed, the particular goods (e.g., yarn tubes) to be packaged, and the like. Typically, however, the connecting portions 46, 47 will have a length of about one to four inches. The slits 30, 31 or the perforations 40, 41 typically extend several inches (e.g., 6 to 12 inches) toward the central portion of the carton, the length of the lines of separation again being dependent upon the depth of the carton 15, the material of which it is made, the goods being packaged, etc.

In order to facilitate folding over of side panel 12 when access to the bottom of the carton is desired, a horizontal score line 50 is preferably formed in the carton blank. The horizontal score line 50 preferably is provided at the bottoms of the lines of separation (40, 41 in FIG. 1, 30, 31 in FIG. 2). It is anticipated that as the carton side panel 12 is being folded over, clean tearing will occur along the corners 32, 33 up to the score line 50. The score line 50 provides for the clean and effective folding over of the panel 12 to allow access to the interior bottom of the carton 15.

In the method of utilization of the carton 15, first it is packaged with goods, e.g., yarn tubes, which packaging step may be accomplished utilizing tilting tables or the like, depending upon the articles being packaged and the depth of the cartons 15. The open top flaps 18 through 21 are folded over in the desired juxtaposition after packaging, and secured in place such as with strapping tape or the like. The carton full of goods is then shipped to its ultimate destination, and at its ultimate designation, the top is opened by cutting the tape, or the like, and folding out the top panels 18 through 21. Then, the top-most portion of the interior of the carton 15 is unpacked, and once it becomes difficult to continue unpacking, the side panel 12 is folded over.

To effect folding over of the side panel 12, the worker severs the connecting portions 46, 47 (see FIG. 3). This may be accomplished by the worker taking his/her hand and impacting the panel 12 adjacent one of the connecting portions (e.g., 46), and then the other (e.g., 47), preferably from an interior portion of the container 15. Alternatively, the connecting portions 46, 47 may be severed utilizing a cutting stroke with a blade (e.g., knife or carton cutter). Once the connecting portions 46, 47 have been severed, the side panel 12 may be readily bent over since the lines of separation (e.g., slits 30, 31) offer no resistance to movement of the top of the side panel 12 away from the rest of the carton, and the side panel is folded about the score line 50, so that it is down and out of the way (see FIG. 4). Since the entire upper portion 53 of the side panel 12 has been removed by this action, easy access is provided to the bottom interior of the container, and in fact access may be readily provided for two workers, not just one, so that if the articles to be unpacked are particularly heavy they may be grasped during unpacking at both sides thereof.

It will thus be seen that according to the present invention a desirable carton, method of manufacture thereof, and method of unpacking thereof, have been provided which have a number of significant advantages. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A cardboard container of generally a rectangular parallepiped shape, comprising four side panels defining the walls of said parallepiped and having a top and a bottom and connected together at generally vertically-extending corners, and means defining a bottom of said parallepiped; and means defining a line of separation at least the corners on opposite sides of one of said panels, said lines of separation in said corners being adjacent, but spaced from, the top of said panel, and said lines of separation having sufficient length so that upon impacting or cutting the portions of said corners above said lines of separation the upper portion of said side panel may be readily detached at said corners, and folded over to allow ready access to the bottom interior of said parallepiped.

2. A container as recited in claim 1 wherein said lines of separation comprise means defining through-extending slits in said corners.

3. A container as recited in claim 1 wherein said lines of separation comprise perforations in said corners.

4. A container as recited in claim 1 further comprising means defining a score line across said panel straddled by said lines of separation, at the bottom-most portions of said lines of separation, to facilitate folding over of the upper portion of the said panel when the portion of said corners above said lines of separation are severed.

5. A container as recited in claim 1 wherein said lines of separation are provided only in two corners of said container.

6. A container as recited in claim 2 wherein said lines of separation are positioned and dimensioned so that upper corner portions of said container above said lines of separation have a length of between about one to four inches.

7. A container as recited in claim 2 further comprising means defining a score line across said panel straddled by said lines of separation, at the bottom-most portions of said lines of separation, to facilitate folding over of the upper portion of the said panel when the portion of said corners above said lines of separation are severed.

8. A container as recited in claim 2 wherein said lines of separation are provided only in two corners of said container.

9. A container as recited in claim 7 wherein said lines of separation are provided only in two corners of said container.

10. A container as recited in claim 1 wherein said lines of separation are positioned and dimensioned so that the upper corner portions of said container above said lines of separation have a length of between about one to four inches.

11. A container as recited in claim 2 wherein each of said side panels has a bottom flap and a top flap connected at a score line thereto, wherein said bottom flaps define said means defining a bottom of said container, and wherein said top flaps are foldable over to define a closed top of said container.

12. A method of constructing a cardboard generally rectangular parallepiped shape container having four side panels, and a bottom, so that at least one of said side panels may be readily bent over from a top portion thereof to allow access to the bottom interior of the container, the side panels being connected to each other at corners, with each side panel being disposed between two corners of a parallepiped container, said method comprising the step of defining lines of separation in two adjacent corners, on opposite sides of the same panel, each line of separation extending from a point near, but spaced from, the top of the corner to a more central point of the corner, and spaced a relatively large distance from the bottom of the container.

13. A method as recited in claim 12 wherein said step of defining lines of separation is practiced by defining through-extending slits in said corners.

14. A method as recited in claim 12 wherein said step of defining lines of separation is practiced by defining perforations in said corners.

15. A method as recited in claim 12 wherein said step of defining lines of separation is practiced to define lines of separation extending from a point about one to four inches from the top of the side panels, for several inches therebelow.

16. A method of opening a cardboard carton having a generally-rectangular parallepiped shape with four side panels, and corners interconnecting the side panels, each side panel being defined by two adjacent vertically-extending corners, the carton having a top and a bottom, and lines of separation in a pair of adjacent corners, the lines of separation near, but spaced from, the top of the carton so that adjacent side panels are connected at the corner above the lines of separation by a connecting portion, the bottoms of the lines of separation extending toward the central portion of said container and being spaced a significant distance from the bottom of the container, said method comprising the steps of:

opening up the top of the container;

unpacking articles from the upper portions of the container;

severing the connecting portions at the top of the container;

folding down the side panel at a horizontal portion at or below the bottom of the lines of separation; and unloading the bottom of the container.

17. A method as recited in claim 16 wherein the container includes a horizontal score line in the panel to be folded down; and wherein said step of folding down the panel is practiced by folding down the panel at said horizontal score line.

18. A method as recited in claim 16 wherein said step of severing the connecting portions is practiced by a human user impacting the panel to be folded over adjacent each of said connecting portions with his/her hand.

19. A method as recited in claim 16 wherein said step of severing the connecting portions is practiced by cutting the connecting portions with a blade.

20. A method as recited in claim 12 comprising the further step of forming a horizontal score line in the panel adapted to be folded over extending between the corners defining the panel at the bottom-most portions of the lines of separation.

* * * * *